United States Patent [101]

Meudec

[11] 4,052,777

[45] Oct. 11, 1977

[54] ROLLERS FOR USE IN PRINTING AND METHOD OF MAKING SAME

[76] Inventor: Alain Meudec, rue de la Tour Coulon, 89000 Laborde par Auxerre, France

[21] Appl. No.: 510,721

[22] Filed: Sept. 30, 1974

[30] Foreign Application Priority Data

Oct. 4, 1973 France ..... 73.35466

[51] Int. Cl.[2] ..... B21B 31/08

[52] U.S. Cl. ..... 29/120; 15/186; 427/206

[58] Field of Search ..... 29/120; 427/206; 15/186, 188, 159, 187

[56] References Cited

U.S. PATENT DOCUMENTS

| | | | |
|---|---|---|---|
| 2,686,326 | 8/1954 | Leathers | 15/186 |
| 2,715,074 | 8/1955 | Hirschberger | 427/206 |
| 2,730,770 | 1/1956 | Higginbotham et al. | 29/120 X |
| 2,789,075 | 4/1957 | Stahl | 29/120 X |
| 2,845,648 | 8/1958 | Peterson | 15/188 |
| 3,194,702 | 7/1965 | Geller et al. | 427/206 |
| 3,445,906 | 5/1969 | Mitchell | 29/131 X |
| 3,460,222 | 8/1969 | Mitchell | 29/120 |
| 3,518,970 | 7/1970 | Burns et al. | 29/120 X |
| 3,639,957 | 2/1972 | Mitchell | 29/120 |
| 3,808,657 | 5/1974 | Menges et al. | 29/120 |

*Primary Examiner*—Reinaldo P. Machado
*Attorney, Agent, or Firm*—Brisebois & Kruger

[57] ABSTRACT

Transfer or cleaning roller for use in offset printing is flocked with fibers adhesively secured to the roller by a layer of elastic binder. The outer ends of the fibers project from the layer of binder but are coated therewith, with the possible exception of their tips, which may be free of binder in the case of transfer rollers.

12 Claims, 2 Drawing Figures

ROLLERS FOR USE IN PRINTING AND METHOD OF MAKING SAME

SUMMARY OF THE INVENTION

This invention relates to improvements in the rollers used in printing, and especially in offset printing, for moistening and inking purposes, etc.

It is conventional for these various purposes to provide a roller, for example, a rubber roller or one made of a flexible plastic material, with a cover of cloth or leather. Such rollers are, for example, used in the offset process to insure the moistening of the plate before it is inked, and it is the present practice to use a knitted tubular sleeve of seamless construction. It is difficult to thread such a sleeve on the support because the sleeve must grip the support very tightly. Moreover, these sleeves have the disadvantage, especially when they are new, that they tend to shed. The particles shed by the sleeve are deposited on the plate and cause defects in the printed impression.

It has been suggested that these knitted tubular sleeves be replaced by velvet coverings, sewn or adhesively secured to the support, which are less subject to shedding. The common disadvantage of these two types of coverings is that they have a seam which leaves traces on certain types of work, in particular, flat work.

It has also been proposed that sleeves be used which contract when they come in contact with water, which facilitates their mounting on the support. These, however, require supports of special hardness. Moreover, they are thin, and for this reason retain an inadequate supply of liquid and dry rapidly whenever the machine is stopped. Moreover, they are very fragile when dry and quite expensive.

All these coverings, with the exception of adhesively secured coverings, have the additional disadvantage of twisting about the support if the tension thereon is insufficient. They are, in general, difficult to wash because the moisteners pick up ink during the operation and this ink penetrates into the fibers of the cloth or knitted material.

For inking during offset printing, it has also been suggested that a roller be used which is covered with teaseled leather. These rollers have good absorptive qualities with respect to the ink and make it possible to eliminate many of the defects in printing such as specks or flecks which are caused by particles shed by the moisteners, or powders or particles of paper, or particles of ink. These rollers covered with leather have, however, various disadvantages. In the first place, it is necessary to use a different roller for each color of ink because the leather absorbs the ink and cannot be completely cleaned. Moreover, they have a seam along their entire length and the leather must be frequently restretched. The leather must also be frequently teaseled to preserve its properties.

It has also been suggested that the surface of a printing roller be covered with textile fibers deposited by flocking. These rollers have not been practical because they had certain disadvantages. In the first place, the fibers came unstuck easily when subjected to substantial friction during use. Moreover, the fibers lay tangentially which considerably reduced the supply of water contained by these rollers when used for moistening purposes.

The present invention is designed to improve the properties of printing rollers the surface of which is covered by textile fibers deposited by flocking in order to permit their use in the printing field without suffering from the disadvantages of known rollers. One object of the present invention is to permit the inexpensive manufacture of a moistening roller adapted to deposit a film of water on a plate-carrying cylinder.

It is also an object of the present invention to provide a particle-collecting roller which is inexpensive and reliable in operation so as to collect practically all of the particles from a plate-carrying cylinder with which the roller cooperates.

Finally, it is an object of the invention to provide a process permitting the easy and inexpensive manufacture of a printing roller having improved properties.

The roller according to the invention has on its surface textile fibers deposited by flocking and is characterized by the fact that the textile fibers are connected to each other by an elastic binder surrounding the fibers over at least a substantial part of their length.

The use of a binder makes it possible to consolidate the attachment of the fibers to their support to form a relatively rigid assembly which has a certain porosity. Moreover, when used as an inking roller, the fibers are not in contact with the ink.

The fibers used may be natural, artificial or synthetic fibers. For a moistening roller, rayon is preferred, and for a particle collecting roller, nylon is preferred.

The particle collecting roller according to the invention has individual fibers the fineness of which lies between 4 and 20 deniers and a fiber length of 0.5 - 3 mm.

A representative particle collecting roller may advantageously be made from nylon fibers having a fineness of 6 deniers and 1 mm long.

For a moistening roller, the fineness of the fibers is between 4 and 20 deniers and the length of the fibers is between 1 and 3 mm. For such a roller, a rayon fiber is preferably of the order of 5 deniers and about 1.5 mm long.

The elasticity of the binder, when solidified, is that of a rubber having, in the pure state, a Shore hardness of between 25 and 90 and preferably between 55 and 70.

The binder may be a solution of rubber or a polyurethane base binder, a polyvinyl chloride, or any other elastic binder. Preferably the flocking adhesive may have the same chemical structure as the binder.

The construction of the particle collecting roller is characterized by the fact that the fibers, in at least most cases, are entirely covered by the binder and that between the fibers or groups of fibers connected together are free spaces extending over a substantial portion of the length of the fiber. Thus the roller has, from its surface outward, a thin layer of flocking adhesive, for example between 10/100 and 2/10th of a mm. thick, and a thicker layer of binder, for example, one third of the total length of the fibers, with the fibers projecting from said layer but being themselves covered with binder. The structure of the moistening roller is distinguished from that of the particle collecting roller solely by the fact that the layer of binder is much thinner, so that a much longer flexible portion of the fibers, which is also covered by the binder, extends from the layer. In a particularly advantageous manner the ends of the fibers of this moistening roller may have no binder so that these fibers can absorb moisture.

The process according to the invention comprises the steps of depositing on a cylinder, for example, a metallic cylinder covered with a flexible layer of rubber, polyvinyl chloride, or another elastomer, a thin layer of flocking adhesive, flocking the roller with textile fibers, preferably by an electrostatic flocking process, drying the adhesive, removing the excess of fibers deposited on the cylinder, and then coating the flocked cylinder with at least one layer of elastic binder.

In order to produce the particle collecting roller, the cylinder may advantageously be rotated about a horizontal axis after the application of the binder during drying of the binder.

In an advantageous method of making a moistening roller, a less viscous binder is used than in the case of a particle-collecting roller. After application of the binder, the moistening roller is preferably positioned vertically and the positions of its ends reversed after a certain time. When the binder is dry, the tips of the fibers are cleaned, for example, by mounting the roller on a turntable and treating its surface with an abrasive cloth.

The layer of flocking adhesive is applied with a brush or spray gun. Preferably the layer of binder is applied with a brush.

The support on which the fibers are mounted may be metallic or synthetic. In particular, it is possible to provide an intermediate textile layer between the support and the fibers. The surface of the roller may be smooth.

The porous and spongy nature of the roller according to the invention enables it to absorb a large supply of liquid. The structure is sufficiently rigid to resist the forces applied thereto during use and the textile fibers, even though they project, are anchored sufficiently well to prevent their being torn off by friction.

Other advantages and characteristics of the invention will appear from a reading of the following description of a preferred embodiment thereof, given purely by way of illustration and example, with reference to the accompanying drawings, in which.

1. Manufacture of a Particle-Collecting Roller

A metallic cylinder is used, for example, one made of a steel conventionally used in the manufacture of particle-collecting rollers, said roller being covered in a known manner with a thick sleeve of rubber or an elastomer. A thin layer of an elastic flocking adhesvie is sprayed thereon. This adhesive is very viscous having a viscosity of 30 - 100 centipoises and preferably 45 to 85 centipoises according to the LVT Brookfield test, 30t/mn, rotor No. 2/25° C. Such an adhesive may, for example, be the adhesive sold under the designation UK 1430 by the Henkel company of Germany.

Immediately after the application of this layer, the roller is electrostatically flocked with 6 denier nylon fibers 1 millimeter long until a surplus of fibers has been applied. The adhesive is then permitted to dry or drying is facilitated by heating. After drying, the surplus fibers are removed by brushing. The fibers are then coated by applying the binder UK 1430 above specified, having the same viscosity, with a brush. This coating with a brush has the effect of creating an excess of binder.

After coating, the roller is mounted on a horizontal axis and rotated slowly until the binder is dry. During this rotation the excess binder is eliminated. After drying of the binder, the roller is ready for use.

It is remarkable to observe that a roller made in this manner will pick up practically all the particles appearing on a plate-carrying cylinder, the most resistant particles being removed upon completion of the third turn of the cylinder, whereas known rollers will not pick up more than 60 to 70% of these particles.

2. Manufacture of a Moistening Roller

In the same way as already described, 5 denier rayon fibers of 1.5 mm in length are flocked. After drying of the adhesive and removal of the excess fibers, the roller is coated with the same binder as before, but in a more dilute state, for example, in a solution containing $\frac{1}{3}$ of binder per $\frac{2}{3}$ of a solvent, such as toluene.

After coating with an excess of binder, the roller is positioned vertically and the excess is permitted to run off. After a certain amount of time, the roller is positioned vertically on its other end until drying of the binder has been completed.

Once the binder has been dried, the roller is mounted on a turntable and rotated while applying thereto an abrasive cloth so as to remove part of the binder which covers the free end of the flocked fibers.

As a variation, when using a binder such as rubber for example, the binder may advantageously be diluted with benzene when used to coat the moistening roller.

Figure 1:
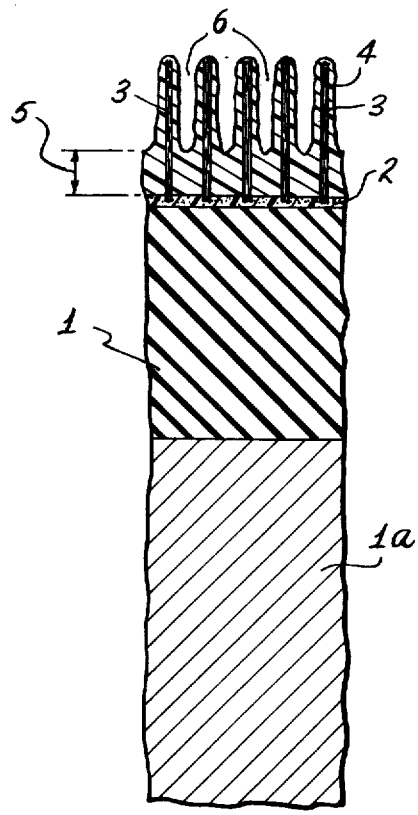
FIG. 1 is a schematic view in axial section on an enlarged scale of a particle-collecting roller.

FIG. 1 shows the rubber sleeve 1 coaxial with the shaft 1*a*. The inner metallic cylinder is not shown. On the sleeve 1 is located a thin layer of adhesive 2 into which the bases of the nylon fibers 3 penetrate. It will be seen that the nylon fibers are covered with binder 4 which forms, above the layer 2, a layer having a thickness 5, for example of the order of $\frac{1}{3}$ of the total length of the fibers 3. It will be seen that the fibers are entirely covered by the binder 4 but that there are spaces or cells 6 between the fibers which may receive the particles to be collected.

Figure 2:
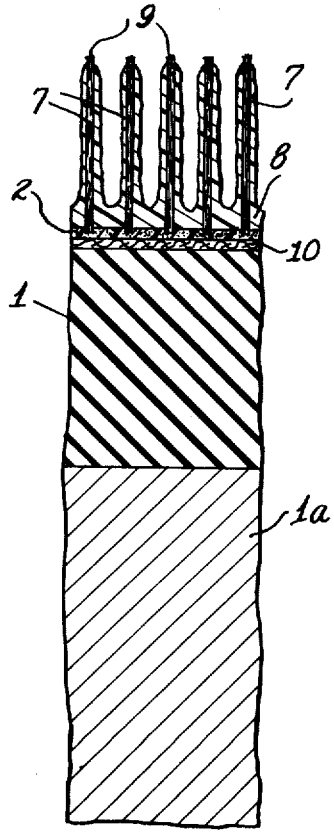
FIG. 2 is a schematic view, partially in axial section, on an enlarged scale, of a moistening roller.

Referring now more particularly to FIG. 2, this shows the rayon fibers 7 positioned in the adhesive 2 and a layer of binder 8 which is thinner than the layer 5. It will also be seen that the tips 9 of the fibers are free of binder, and a textile layer 10 is provided between the sleeve 1 and the adhesive 2.

What is claimed is:

1. Printing roller comprising a support, a first thin adhesive layer on said support flocked with textile fibers having one end adhesively secured to and embedded in said first layer and projecting radially therefrom, a second layer of elastic binder applied on said first layer and connecting said fibers to each other, the thickness of said second layer being greater than that of said first layer, and said fibers projecting outwardly beyond said second layer.

2. Printing roller as claimed in claim 1 wherein the part of each fiber which extends outward from said second layer has a coating of said elastic binder, the coatings on adjacent fibers being discrete from each other over at least most of their length.

3. Roller as claimed in claim 1, in which the textile fibers have a length between 0.5 and 3 mm and a fineness between 4 and 20 deniers.

4. Roller as claimed in claim 1, in which said binder is selected from the group consisting of rubber, polyvinyl chloride and polyurethane.

5. Roller as claimed in claim 1, in which the Shore hardness of the pure binder lies between 25 and 90.

6. Roller as claimed in claim 1, in which the binder is of the same material as the flocking adhesive.

7. Roller as claimed in claim 1, in which the viscosity of the adhesive lies between 30 and 100 centipoises.

8. Roller as claimed in claim 1, in which the binder incompletely covers the fibers, which have a free end uncovered by binder.

9. Roller as claimed in claim 1, in which the surface of the roller is straight.

10. Roller as claimed in claim 1, in which said support is metallic.

11. Roller as claimed in claim 1, in which said support has a base made of a material having the elasticity of rubber.

12. Roller as claimed in claim 1, comprising a textile layer interposed between the support and the flocked fibers.

* * * * *